US012680392B2

(12) United States Patent
Maghoul et al.

(10) Patent No.: US 12,680,392 B2
(45) Date of Patent: Jul. 14, 2026

(54) VIBRATORY BURROWING PROBE FOR INVESTIGATING SUBSURFACE REGIONS OF GRANULAR MEDIA IN IG AND LOW/MICRO GRAVITY CONDITIONS

(71) Applicants: University of Manitoba, Winnipeg (CA); Polyvalor, Limited Partnership, Montreal (CA)

(72) Inventors: Pooneh Maghoul, Montreal (CA); Mahdi Alaei Varnosfaderani, Winnipeg (CA); Nan Wu, Winnipeg (CA)

(73) Assignees: University of Manitoba, Winnipeg (CA); Polyvalor, Limited Partnership, Winnipeg (CA)

( * ) Notice: Subject to any disclaimer, the term of this patent is extended or adjusted under 35 U.S.C. 154(b) by 0 days.

(21) Appl. No.: 18/857,936

(22) PCT Filed: Apr. 17, 2023

(86) PCT No.: PCT/CA2023/050516

§ 371 (c)(1),
(2) Date: Oct. 18, 2024

(87) PCT Pub. No.: WO2023/201417

PCT Pub. Date: Oct. 26, 2023

(65) Prior Publication Data

US 2025/0263984 A1 Aug. 21, 2025

Related U.S. Application Data

(60) Provisional application No. 63/332,775, filed on Apr. 20, 2022.

(51) Int. Cl.
*E21B 7/24* (2006.01)

(52) U.S. Cl.
CPC ..... *E21B 7/24* (2013.01)

(58) Field of Classification Search
CPC . E21B 7/24; E21B 7/208; E21B 7/206; E21B 28/00; E21B 4/12; E21B 49/00; E21B 31/005; B64G 99/00
See application file for complete search history.

(56) References Cited

U.S. PATENT DOCUMENTS 7,740,088 B1 * 6/2010 Bar-Cohen ..... E21B 6/08 310/323.19
2004/0007387 A1 * 1/2004 Bar-Cohen ..... E21B 44/00 175/316

(Continued)

FOREIGN PATENT DOCUMENTS

DE 102011089010 A1 * 6/2013 ..... G01F 23/226

*Primary Examiner* — Daniel P Stephenson
(74) *Attorney, Agent, or Firm* — Kyle R Satterthwaite; Ryan W Dupuis; Ade & Company Inc.

(57) ABSTRACT

A compact vibratory burrowing probe, particularly beneficial in low gravity space exploration environments, uses lateral or stirring-like vibrations to fluidize a surrounding regolith, thereby decreasing the penetration resistance, and compensating for the light overhead weight to improve the burrowing action of the probe into the surface of the terrain of explored moons, planets, or asteroids. Included is a novel vibratory mechanism capable of imparting the novel lateral or stirring vibration, as well as a more conventionally oriented longitudinal vibration.

20 Claims, 4 Drawing Sheets

(56) References Cited

U.S. PATENT DOCUMENTS

| | | | | |
|---|---|---|---|---|
| 2004/0089461 | A1* | 5/2004 | Cioceanu | E21B 4/10 173/90 |
| 2007/0119241 | A1* | 5/2007 | Su | G01Q 10/06 73/105 |
| 2013/0131705 | A1* | 5/2013 | Akagane | A61B 17/320068 606/169 |
| 2013/0292179 | A1* | 11/2013 | Pikowski | E21B 6/04 175/56 |
| 2017/0218577 | A1* | 8/2017 | Lindley | E04F 21/24 |
| 2017/0226806 | A1* | 8/2017 | Nguyen | E21B 7/24 |
| 2020/0149367 | A1* | 5/2020 | Doster | E21B 17/07 |
| 2025/0263984 | A1* | 8/2025 | Maghoul | E21B 7/24 |

* cited by examiner

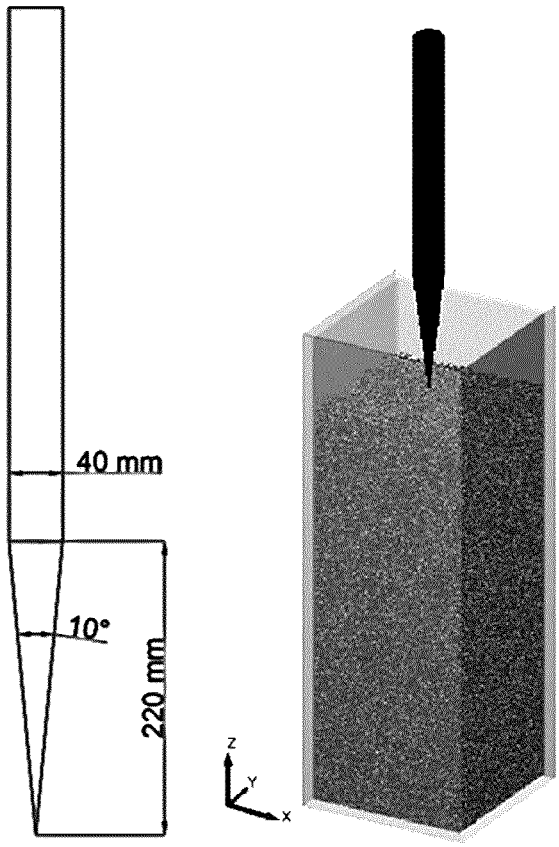
Figure 1. Probe's dimensions and model in EDEM.
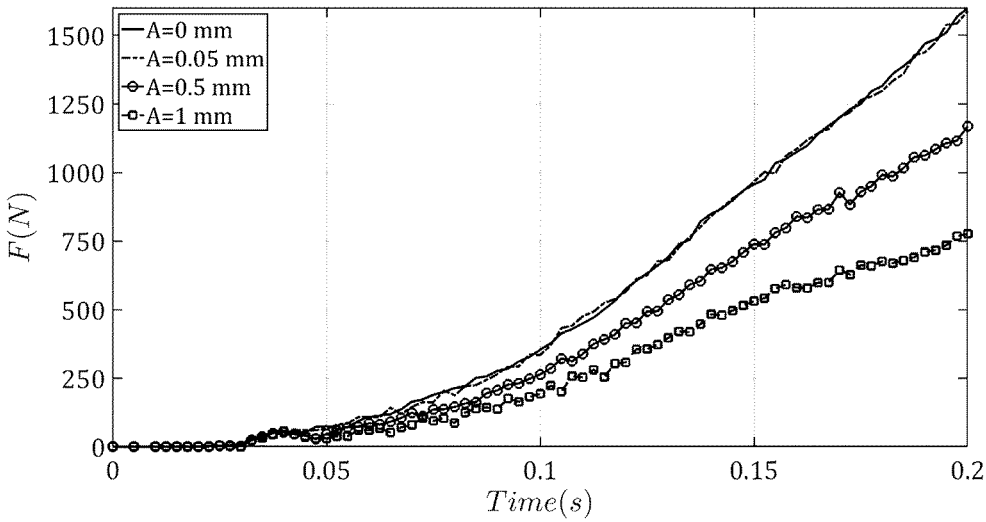
Figure 2. Total vertical force in different vibration amplitude at frequency 500 Hz

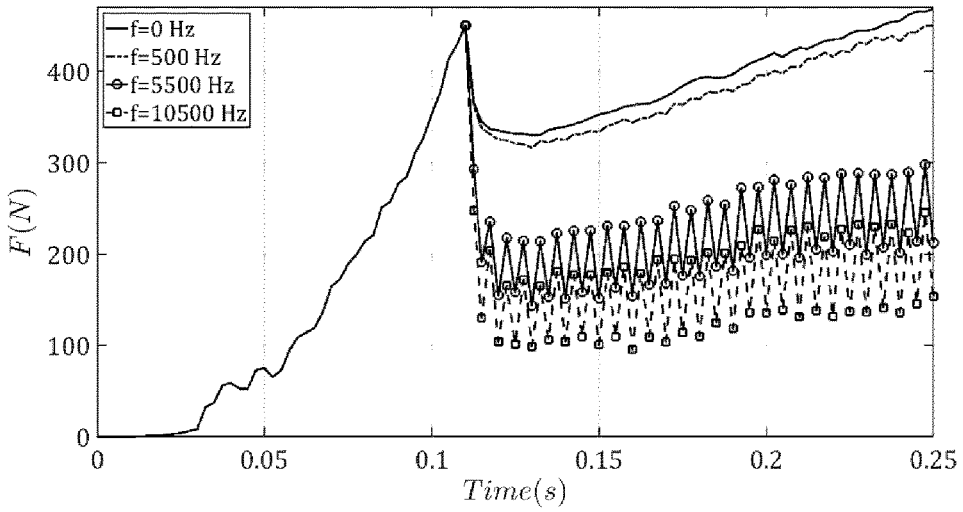
Figure 3. Total vertical force in different frequencies with amplitude of 0.05 mm
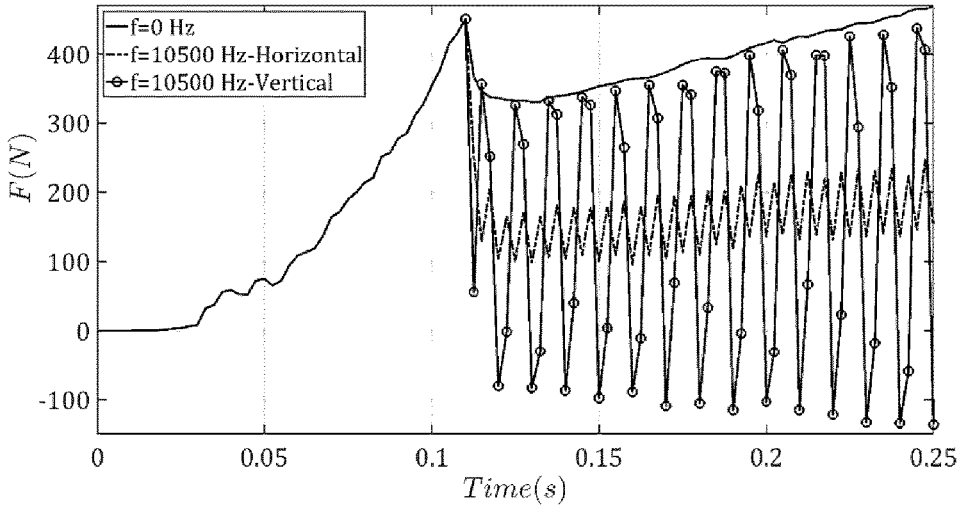
Figure 4. Total vertical force in longitudinal and lateral vibration with amplitude of 0.05 mm

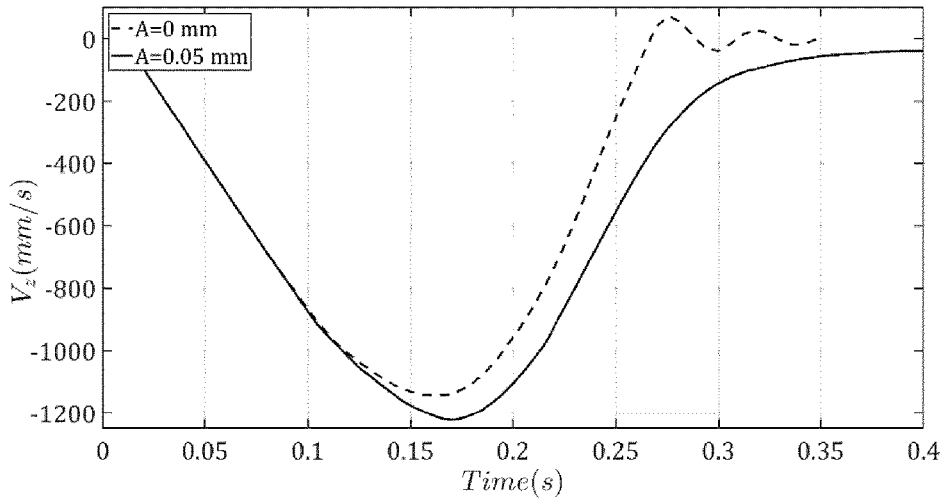
Figure 5. Vibration impact at the frequency of 10500 Hz on the penetration rate for the conical nose ($\alpha = 10.4°$)
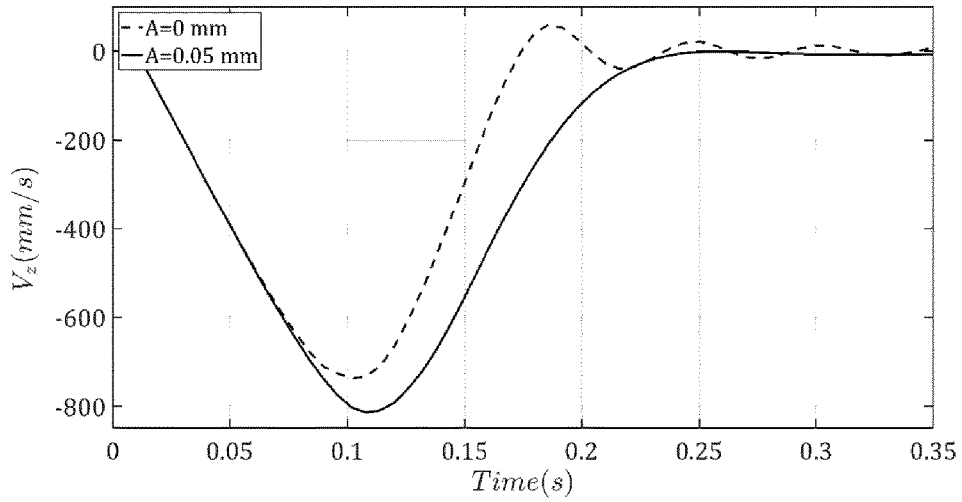
Figure 6. Vibration impact at the frequency of 10500 Hz on the penetration rate for ogival nose ($CRH = 3$)

VIBRATORY BURROWING PROBE FOR INVESTIGATING SUBSURFACE REGIONS OF GRANULAR MEDIA IN IG AND LOW/MICRO GRAVITY CONDITIONS

FIELD OF THE INVENTION

This application relates generally to the field of subsurface investigation, and more particularly to burrowing probes that use a combination of force and vibration to penetrate or burrow through granular materials on Earth (1 g) or planetary bodies (low/micro gravity conditions <1 g).

BACKGROUND

Due to payload limitations in space missions, there exists a demand for the development of lightweight and compact investigation tools that can be employed for subsurface exploration on the Moon, Mars, and beyond.

Percussion is instrumental in fracturing rigid, brittle materials such as concrete, stones, and ceramics. In contrast, rotation is more effective in soft and ductile materials such as wood and plastics (Badescu et al., 2013). One of the proposed designs to overcome the drilling challenges in planetary missions was an ultrasonic/sonic driller/corer (USDC) mechanism for rock drilling (Sherrit et al., 2000). The USDC consists of three main parts: an ultrasonic horn transducer (actuator: piezoelectric stack, backing element, and a horn), a free mass, and a drill stem. The piezoelectric stack is confined and remains in compression between the backing and the variable cross-section horn. The horn amplifies the longitudinal vibrations from the piezoelectric stack and vibrates at its resonant frequency of around 21.5 kHz. It results in a free mass vibration between the horn tip and the top of the drill stem with average frequencies between 100 and 1000 Hz. Sonically stress pulses transfer ultrasonic energy from the transducer to the drill stem and create shock waves at the bit/rock interface. Rock fracture occurs when fatigue strength is finally passed by hammering. The lightweight (450 g) prototype proved to be efficient for drilling different rocks at shallow depth with low preload (less than 5 N) and low driven power (Bao et al., 2003). Subsequently, the device was mounted on several rover configurations (Sojourner Rover and FIDO Rover) (Bar-Cohen et al., 2001). However, removing fractured rocks after a certain depth becomes problematic and reduces its efficiency (Wang et al., 2018). Cardoni et al. (2010) proposed two new ultrasonic drilling devices where the ultrasonic bits were designed to transform the longitudinal vibrations into longitudinal-torsional vibration. In their preliminary drilling tests, it was observed that composite mode devices could improve drilling/coring efficiency.

Firstbrook et al. (2014) conducted a series of experiments to observe high-powered ultrasonic vibration effects on penetration in granular materials. An ultrasonic Langevin transducer provided ultrasonic vibration of 20 kHz up to 10 μm amplitude. The horn, penetrator, was manufactured from 94Ti/6Al/4V alloy and designed to resonate in the second longitudinal mode at 20 kHz with the resulting amplification ratio (gain) of 3.5. The rig was set to penetrate into different Martian regolith simulants with high and low density at slow (3 mm/s) and fast (9 mm/s) rates corresponding to 4.81 V and 12 V, respectively. While slow non-ultrasonic penetration needed a larger overhead force, they observed the opposite was true in ultrasonic penetrations. Moreover, adding ultrasonic vibrations led to a marked reduction of the required peak axial force. It seems that the ultrasonic vibration provides granular fluidization in the immediate surrounding of the drill, reducing the surface friction and assisting sand particles mobilization and the probe penetration. The highest reduction of axial force occurred using the lowest amplitude of 1 μm, which corresponded to the lower total power consumption (actuator and ultrasonic units). After that, the peak penetration force reduction became more gradual and less conspicuous. Interestingly, the high-density regoliths exhibited a more significant reduction in the peak force than the low-density regoliths by implementing ultrasonic vibrations. Therefore, incorporating the ultrasonic vibro-based technique in self-burrowing probes seems helpful for penetration into the lunar regolith, which has a high relative density just a few centimetres below the surface.

In their subsequent study, (Firstbrook et al., 2017) investigated the effect of gravity on the penetration of probes in granular media. They only considered the high-density regoliths with the faster penetration rate (9 mm/s-12 V) with a higher resolution of amplitude in the range of 0-2 μm. The tests were conducted in a centrifuge, a cost-effective method to examine gravity's effects by observing the penetration in higher gravities (1 g-10 g) and then extrapolating results downward. Regardless of gravity, the ultrasonic vibrations assisted penetration. Higher gravities led to implementing higher axial forces. Moreover, in lower gravities, the percentage of reduction in penetration forces was higher. For example, they observed that the force could be reduced by 70% in 1 g and 1 μm amplitude of vibration, while the reduction would be just 50% in 10 g for the same vibration's amplitude. Therefore, the trend suggests that these benefits could be advantageous in lower gravity to compensate for the lower weight and force on the drill bit. Similarly, Firstbrook et al. (2018b) observed noticeable enhancements in a percussive probe's drilling efficiency by synchronizing short ultrasonic vibration pulses with the hammer impact. The number of hammer strikes needed to achieve a specified depth (190 mm) at the highest excitation amplitude (1.6 μm) was reduced from 48 to 15 and from 33 to 17 for block paving sand (BP) (Dr=48.3%) and lunar regolith simulant SSC-3 (Dr=43.1%), respectively. In addition, it was noticed that at low penetration depths, implementing only ultrasonic vibration could fluidize the sand to such an extent that the penetrator had a brief moment of near-freefall. This advantage is beneficial for future probe applications on the moon. The probe can exploit the ultrasonic vibration to bury itself into the loose regolith on the moon's surface on its weight. Subsequently, the ultrasonic vibration performs its capacity to assist the primary mechanism in penetrating into the dense regolith just a few centimetres below the surface.

Firstbrook et al. (2018a) investigated the effects of ultrasonic vibration on auger drilling performance. Glass microspheres with a particle size distribution of 150-250 μm were chosen to replicate the penetration in fine sand. The maximum overhead force was approximately reduced from 600 N to 100 N only by implementing rotary penetration (14.7 RPM) compared to the non-rotary one. On the other hand, ultrasonic vibration was able to reduce it roughly to 350 N in the non-rotary penetration by implementing an amplitude of 10 μm. Therefore, it seems that rotation has much more significant effects on the reduction of required overhead force than ultrasonic vibrations. Moreover, the required force was independent of any ultrasonic vibration in the rotary penetration, indicating the force had already been adjusted more than ultrasonics could provide. However, the required maximum torque decreased from 120 Nm to 85 Nm (30% reduction) by increasing the ultrasonic vibration amplitude from 0 to 10 μm.

Despite this prior research, there remains a need, for further development of burrowing probe equipment and techniques particularly suited to address the challenges of space exploration, and/or subsurface exploration of relatively inaccessible environments on Earth (mining sites, foundations of dams, etc.).

SUMMARY OF THE INVENTION

According to a first aspect of the invention, there is provided a vibratory burrowing probe for probing subsurface regions within a granular medium, said probe comprising:

- a probe tip shaped for penetration thereof through the granular medium in an axial direction denoted by a longitudinal axis of the probe; and
- a vibratory mechanism operably coupled to the probe tip and operable, in at least one mode of operation, to impart non-longitudinal vibration thereto such that at least a partial component direction of said non-longitudinal vibration has a transversely oriented relationship to said longitudinal axis.

According to a second aspect of the invention, there is provided a vibratory burrowing probe for probing subsurface regions within a granular medium, said probe comprising:

- a probe tip shaped for penetration thereof through the granular medium in an axial direction denoted by a longitudinal axis of the probe; and
- a vibratory mechanism operably coupled to the probe tip and configured to impart vibration thereto;
- wherein said vibratory mechanism comprises a plurality of actuators acting in the axial direction, and is operable, in at least one mode of operation, to drive at least a first subset of said actuators asynchronously of at least a second subset of said actuators to impart at least a partial component direction of the vibration that is of transversely oriented relationship to said longitudinal axis.

According to a third aspect of the invention, there is provided a method of probing subsurface regions of a granular medium, said method comprising:

- driving a probe through said granular medium in an axial direction; and
- during said displacement of the probe in said axial direction, imparting non-longitudinal vibration to at least part of the probe such that at least a partial component direction of said non-longitudinal vibration has a transversely oriented relationship to said longitudinal axis.

BRIEF DESCRIPTION OF THE DRAWINGS

Preferred embodiments of the invention will now be described in conjunction with the accompanying drawings in which:

FIG. 1 schematically illustrates a modeled representation of a laterally vibrated burrowing probe of the present invention, as used in discrete element method testing and evaluation against conventional vibratory probes and non-vibratory probes.

FIG. 2 is a plot of vertical penetrating force vs. time from simulated use of the laterally vibrated probe model at different vibrational amplitudes, with constant penetrating velocity and constant vibrational frequency.

FIG. 3 is a plot of vertical (i.e. axial or longitudinal) force vs. time from simulated use of the laterally vibrated probe model at different vibrational frequencies, with constant penetrating velocity and constant vibrational amplitude.

FIG. 4 is a plot of vertical force vs. time from simulated comparative use of the laterally vibrated probe model operating at 10.5 kHz, a longitudinally vibrated probe operating at the same frequency, and a nonvibratory probe.

FIG. 5 is a plot of penetration velocity vs. time from simulated comparative use of the laterally vibrated probe model, operating at 10.5 kHz, and a nonvibratory probe, both using a conical nose.

FIG. 6 is a plot of penetration velocity vs. time from simulated comparative use of the laterally vibrated probe model, operating at 10.5 kHz, and a nonvibratory probe, both using an ogival nose.

DETAILED DESCRIPTION

Figure 7:
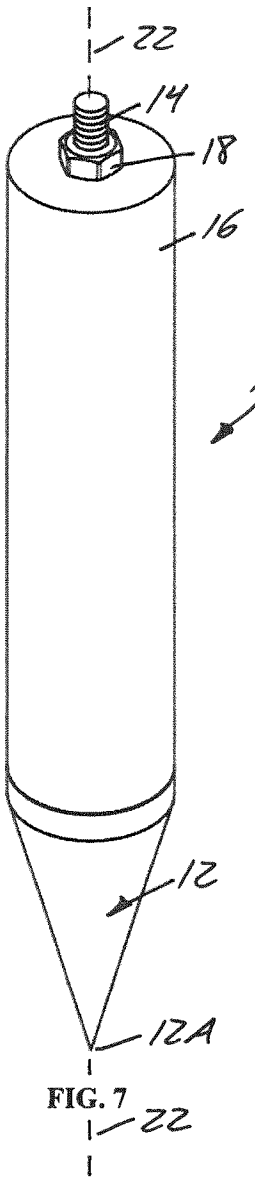
FIG. 7 is as assembled view of one non-limiting embodiment of an inventive vibrational burrowing probe of the present invention.

In the prior studies referenced above, experiments were conducted at 20 kHz, which corresponds to the second longitudinal vibration mode of an ultrasonic horn. Those studies did not investigate whether it is possible to save more energy by using vibrations at lower frequencies, yet still achieve the beneficial effects of vibration. More precisely, the role of vibration frequency was not sufficiently explored. Furthermore, the impact of other vibration modes on penetration into granular materials was left unexplored. In view of this, the presently named inventors undertook exploration of the effect of vibration frequency, bi-directional mode, and the probe's nose geometry on assisting penetrations into granular materials, and employed DEM simulation in such explorations.

More particularly, investigation was made of the effects of high-frequency vibrations on reducing the overhead load required for the penetration of a typical probe into granular media. The Discrete Element Method (DEM) was used to examine the effect of vibration frequency, mode, and the probe's selected head/tip shape on penetration resistance. As demonstrated below, the results show that employing high-frequency vibration is a promising technique for overcoming the payload limitations for subsurface investigation in space or other remote areas.

As shown in Error! Reference source not found., a three-dimensional DEM model was developed in EDEM 2021 (Altair Engineering Inc.) to simulate a vibratory drilling process. The height of the regolith in the sandbox was set at 675 mm. The drilling tool diameter was set at 40 mm, for penetration into a sandbox whose an inner cross-section area was set at 205×205 $mm^2$ and whose height was set at 820 mm to minimize the effects of the boundaries on the drilling process. The size of the drilling tool was set similar to the Dual Reciprocation Oscillation Drill (DROD) system in (Alkalla et al., 2021), with the only exception that a mono head drilling bit was specified instead of two valves. The DEM parameters were selected from Alkalla et al. (2021) to model the lunar regolith qualitatively (see Table 1 below). The Hertz-Mindlin contact model was selected. The particles were modeled with uniformly sized triple spheres to account for the irregularity of lunar regolith shapes. In addition, the Johnson-Kendall-Roberts (JKR) model and standard rolling friction model were added to account for the cohesion and high frictional properties of the lunar regolith.

TABLE 1

DEM model parameters.

| Parameters | Value |
|---|---|
| Number of triple sphere particles | 1344958 |
| Sphere particle radius[a] | 1 mm |
| Particle solid density[a] | 2875 kg/m$^3$ |
| Particle shear modoulus[a] | 50 Mpa |
| Particle Poisson's ratio | 0.25 |
| Particle-Particle friction[a] | 0.5 |
| Particle -Wall friction[a] | 0.2 |
| Coefficient of rolling friction | 0.1 |

[a]From (Alkalla et al., 2021)

In a first simulation, the result of which are plotted in FIG. 2, three laterally vibrated probes of different vibrational amplitude were pushed into the granular materials at a constant speed of 2 m/s for the purpose of evaluating the effects of the lateral vibration on penetration resistance. In each case, the lateral vibration was imparted at a frequency of 500 Hz. Error! Reference source not found. shows that a lateral vibration with an amplitude of 0.05 mm had no noticeable effect on penetration resistance. In contrast, the required vertical force was reduced significantly when the amplitude increased to 0.5 mm and 1 mm. When the amplitude was increased to A=0.5 mm and A=1 mm, the penetration force dropped by approximately 25 percent and 50 percent, respectively.

In a next simulation, the results of which are plotted in FIG. 3, the penetration speed was dropped from 2 m/s to 200 mm/s at t=0.11 s, denoting a time at which the probe head is completely buried under the surface. At this point (t=0.11 sec), lateral vibration with an amplitude of 0.05 mm was added to the vertical motion. The simulation was conducted at various vibration frequencies to investigate vibration's impact on penetration resistance. In comparison to the previous simulation, Error! Reference source not found. shows a more notable reduction in penetration resistance at a frequency of 500 Hz and amplitude of 0.05 mm. Compared to the previous simulation, the penetration speed here is only 200 mm/s, which is ten times slower than before. Therefore, at a lower penetration rate, vibrations of the probe seem to be more effective in reducing the penetration resistance. In other words, the probe can transfer its vibration energy more effectively to the surrounding regolith at a slower penetration rate. Furthermore, increasing the vibration frequency from 500 Hz to 5.5 kHz significantly reduced the maximum penetration resistance by approximately 36%. However, increasing the frequency again from 5.5 kHz to 10.5 kHz had a less noticeable effect on further decreasing the penetration resistance.

Longitudinal (vertical) vibrations with a frequency of 10.5 kHz and amplitude of 0.05 mm were then applied for comparison against the previous lateral (horizontal) vibrations. Error! Reference source not found. shows that the effect of longitudinal vibration on the reduction of the resistance force was inconspicuous compared to lateral vibration. Without being limited to any particularly theory, the postulated reason for this is that the longitudinal vibration has its vibrational displacement (amplitude) oriented in the axial direction of the probe's penetration, which results in compression of the lower layers of the regolith. On the other hand, lateral vibration, with at least a partial directional component of its displacement (amplitude) oriented transversely of the axial direction of the probe's penetration, forces the regolith particles away from the probe's axial penetration path onward through the lower layers of the regolith. Therefore, the lateral vibration is more effective at fluidizing the surrounding soil and assisting the probe's penetration. Based on the experimental results (Firstbrook et al., 2014), longitudinal vibrations seem to require higher frequencies to fluidize the soil particles effectively.

In another simulation, the probe, modeled with a conical nose shape, was assumed to weigh 10 kg. The simulated probe was released into the granular material at t=0.01 s, and initially penetrated the granular material under the probe's own weight. Error! Reference source not found. shows that the probe underwent a free-fall motion at first, until the granular material's resistance force started to decelerate the probe. In the absence of lateral vibration (A=0), around t=0.27 sec, the probe began to bounce, indicating that it had reached the maximum depth to which the probe can penetrate the granular material under the probe's own weight. However, imparting lateral vibration at a frequency of 10.5 kHz and amplitude of 0.05 mm was found to eliminate the rebound. Moreover, at t=0.35 s, the probe penetration rate remained almost constant, and at t=0.39 sec, the probe started to experience a slight downward acceleration.

Next, the above simulation was repeated with another probe model, this time modelled with an ogival nose shape having a Caliber Radius Head (CRH) ratio of 3, but the same diameter as the conically nosed model of the last simulation. This was done in order to observe the effect of the nose shape on the performance. Error! Reference source not found. shows that the vibrated probe still prevent the aforementioned rebound. However, the impact of vibration on the ogival nose was less pronounced than the conical nose plotted in Error! Reference source not found. Based on the empirical equations developed by Young (1997) for high-velocity impacts (less than 1200 m/s), the conical nose has a nose performance coefficient of 1.93, while the ogival nose has a nose performance coefficient of 0.85. Similarly, for the current simulation, quasi-static penetration with lateral vibration, the nose performance effect was prominent. The vibrated ogival nose probe reached an almost constant penetration rate of 6 mm/s at t=0.30 s, while the vibrated conical nose had an almost constant velocity of 40 mm/s around t=0.40 s. Moreover, this is compatible with the result from (Alaei Varnosfaderani et al., 2022), which shows a high-speed probe with a longer nose length can outperform the one with a shorter nose in terms of penetration.

The foregoing DEM simulations were used to analyze the effects of probe lateral vibrations on reducing regolith resistance forces. The simulations show that the required penetration force can be reduced by increasing the vibration frequency or amplitude. However, the rate of the reduction in the required axial force decreases with increasing vibration frequency. Meanwhile, this rate of reduction did not experience the same drop off with increasing vibration amplitude. On the other hand, vibration appears to be more effective at lower penetration rates, where the kinetic energy of the probe's vertical motion is much lower than the kinetic energy of vibration. Furthermore, the nose geometry of the probe (nose performance) played a significant role in the penetration rate achievable at a constant overhead weight. In all the above simulations, the modeled probe was considered as a rigid body, and a few centimeters of penetration were simulated.

Figure 8:
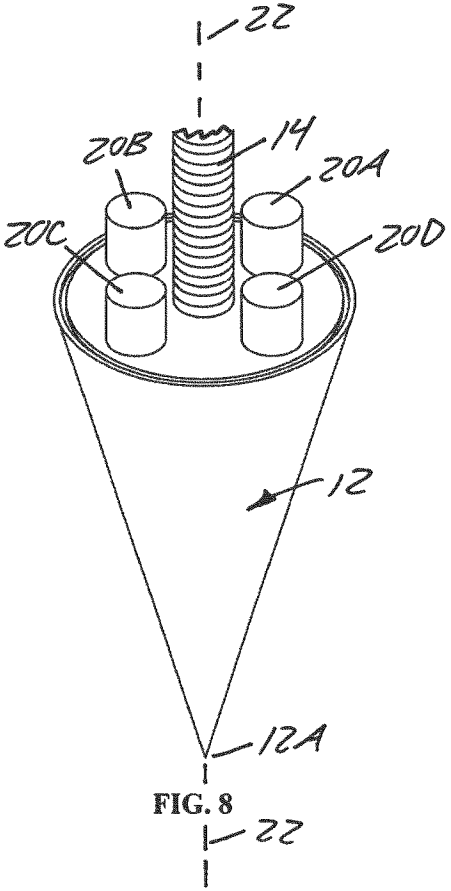
FIG. 8 is a partial fragmentary view of the vibrational burrowing probe of FIG. 7, in a partially disassembled state showing a probe tip thereof, on which a set of piezoelectric actuators are installed at the base of the probe tip.
Figure 9:
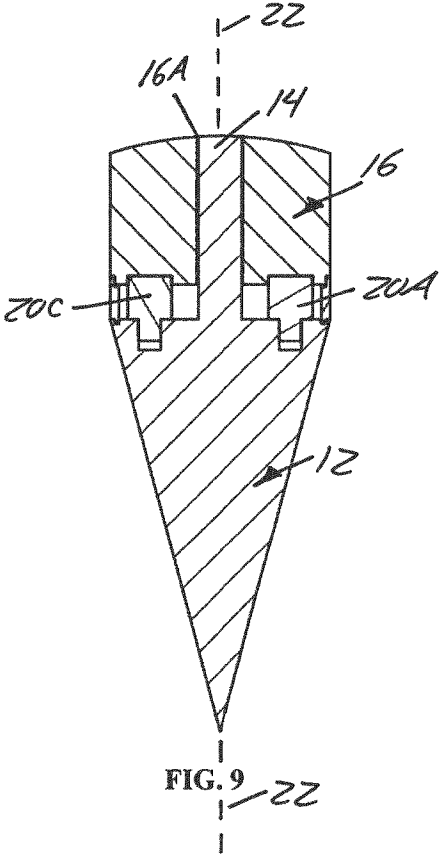
FIG. 9 is a partial fragmentary view of the vibrational burrowing probe of FIG. 7, shown cross-sectioned at a longitudinal midplane thereof.

Turning away from the modeled simulations summarized in FIGS. 1 through 6, attention is now turned to design options for the inventive laterally vibratory probe of the present invention, one non-limiting example of which is illustrated in FIGS. 7 through 9, where piezoelectric materials are used to realize the required vibration at the probe's tip to assist its penetration, As known in the art, such materials are capable of turning electrical energy into mechanical motion and vice versa. Piezoelectric materials are free from electromagnetic interference, can provide quick responses with high frequency and considerable output forces, have very compact and simple designs, making them ideal for working in harsh environments and remote areas.

FIG. 7 shows an assembled view of the probe 10, whose componentry incudes a tip or nose 12 (of conical shape in the illustrated example) that terminates in a pointed apex 12A at a terminal bottom end of the probe to define the penetrative leading part of the probe, a central longitudinal screw shaft 14 that stands vertically upright from the probe tip 12 at the center of a circular top base 12B thereof that resides axially opposite the pointed apex 12A, a cylindrical back mass 16 having a central axial through-bore 16A through which the shaft 14 is received, a threaded nut 18 engaged on the shaft 14 at a threaded segment thereof above the back mass 16, and a set of four piezoelectric actuators 20A-20D mounted atop the base 12B of the probe tib 12. The four piezoelectric actuators 20 are held under pressure between the bottom end of the back mass and the top base 12B of the probe tip 12. Threaded tight against the top end of the back mass 16, the nut 18 holds the back mass 16 in a pre-loaded state bearing forcefully down on the four piezoelectric actuators, and thus creating an initial compression in the four piezo actuators, and also securing the back mass 16 in place in the overall probe assembly. The shaft 14, optionally in cooperation with the same nut 18, or in combination with one or more other cooperating fasteners, also serves as a connector by which the assembled probe 10 is connectable to a drive source (for example, a robotic arm, not shown) responsible for applying the required vertical force to the probe to drive its penetrating displacement downward through the granular material being probed.

The vibratory mechanism for imparting the vibration to the probe is composed of the four piezoelectric actuators 20A-20D, and suitably connected electronic drive circuitry capable of applying drive signals thereto in the manner described herein, details of which are well within the ambit of those of ordinary skill in the art, and thus not specifically detailed herein. The four piezoelectric actuators and the drive circuitry are wired in such away that different respective drive signals of varying phase angle from one another can be individually applied to the different actuators. In the non-limiting four-actuator example of the illustrated embodiment, the four actuators are evenly distributed in circumferential relation around the central shaft 14, at 90-degree intervals to one another. As a result, a first pair of the actuators 20A, 20B are situated one side of a bisecting longitudinal midplane of the probe, in which there is contained a central longitudinal axis 22 on which the central shaft 14 is centered, and on which the pointed terminal apex 12A of the probe tip 12 resides when in a relaxed (non-vibrating) state.

This longitudinal axis 22 denotes an axial travel direction along which the probe is displaced through the granular media. In the novel application of lateral vibration to the probe, at least a partial directional component of the vibratory movement of the probe tip is non-axial, and instead occurs in radial directions lying transversely (crosswise) of the longitudinal axis 22, whereas the prior art employed longitudinal vibration whose vibratory displacement (amplitude of vibration) is imparted in purely parallel relation to the longitudinal axis 22. The second pair of actuators 20C, 20D reside on the opposing side of the bisecting longitudinal midplane, so that each pair resides on a respective side of the midplane, and thus on a respective side of the longitudinal axis 22 residing in that midplane.

The novel vibratory mechanism is operable in different modes, and is thereby capable of performing vibration in the conventional longitudinal direction, as well as in the novel lateral direction. In longitudinal mode, the vibratory mechanism generates longitudinal vibration by using four similar signal input voltages applied to the four piezoelectric actuators 20A-20C at equal phase angles to one another so that they synchronously expand and contract in the axial direction. For the lateral vibration, a similar signal is applied to the first pair of actuators 20A, 20B at equal phase angle to one another, while the same signal offset by a 180-degree phase angle difference is applied to the second pair of actuators 20C, 20D so that their expansion and collapse is offset in time by one half cycle. Accordingly, as one pair of actuators 20A, 20B is expanding, the other pair 20C, 20D is collapsing, and vice versa, whereby this asynchronous cycling of the two pairs at a half cycle offset generates lateral vibration of the probe tip 12.

In addition to these longitudinal and lateral vibration modes, the vibratory mechanism is also capable of generating a novel a stirring-movement vibration at the probe's tip 12. In this stirring mode, the same drive signal voltage is again used for all actuators, but the drive signal applied to each actuator has a phase angle difference of 90-degrees from its circumferentially neighbouring actuator, and a phase angle difference of 180-degrees from its diametrically opposing actuator situated across the central longitudinal axis 22. So, when the first actuator 20A is at its drive cycle's positive peak, the second actuator 20B is at its drive cycle's downward zero-crossing, the third actuator 20C is at its drive cycle's negative peak, and the fourth actuator 20D is at its drive cycle's upward zero-crossing. So, at any given moment where one actuator is at its drive cycle's positive peak, its two circumferentially neighbouring actuators are at their neutral zero crossings, and its diametrically opposing actuator is at its negative peak. The "stirring mode" vibration is thus more comparable to the type of vibration one would see with an eccentric rotating mass vibration motor, where the point of maximum vibration amplitude is cycling circumferentially around the longitudinal axis 22, versus the lateral vibration mode, where the point of maximum vibration amplitude is instead cycling in alternating fashion back and forth across the midplane and central axis 22.

Though the individual expansions and contractions of the piezoelectric elements are occurring in the longitudinal direction, the phase offset of their drive cycles means the individual pulsations thereof are imbalanced from one another, causing the apex 12A of the probe tip 20 to vibrate laterally/radially off of the central longitudinal axis 22, unlike the purely axial vibrational displacements of a conventional longitudinally vibrated probe of the prior art. It will be appreciated however that the particular vibratory mechanism described and illustrated herein is just one example by which vibration of the probe may be accomplished in one or more of the different vibration modes described herein, including the inventive lateral and stirring modes, as the conventional longitudinal mode, where operation at notably different frequencies form the prior art is nonetheless distinctive, despite sharing the same longitudinal direction of the tip's vibrational displacement.

Since various modifications can be made in my invention as herein above described, and many apparently widely different embodiments of same made, it is intended that all matter contained in the accompanying specification shall be interpreted as illustrative only and not in a limiting sense.

REFERENCES

Each of the following references is incorporated herein by reference in its entirety.

Alaei Varnosfaderani, M., Maghoul, P., & Wu, N. (2022). Modelling the penetration of subsonic rigid projectile probes into granular materials using the cavity expansion theory. *Computers and Geotechnics,* 141, 104546. https://doi.org/10.1016/j.compgeo.2021.104546

Alkalla, M., Pang, X., Pitcher, C., & Gao, Y. (2021). DROD: A hybrid biomimetic undulatory and reciprocatory drill: Quantitative analysis and numerical study. *Acta Astronautica,* 182, 131-143. https://doi.org/10.1016/j.actaastro.2021.02.007

Altair Engineering Inc. (n.d.). *Introduction to Altair EDEM and Physics models*. Retrieved Dec. 14, 2021, from https://www.altair.com/resource/introduction-to-altair-edem-and-physics-models Badescu, M., Hasenoehrl, J., Bar-Cohen, Y., Sherrit, S., Bao, X., Chang, Z., Ostlund, P., & Aldrich, J. (2013). Percussive augmenter of rotary drills (PAROD). In J. P. Lynch, C.-B. Yun, & K.-W. Wang (Eds.), Sensors and Smart Structures *Technologies for Civil, Mechanical, and Aerospace Systems* 2013 (Vol. 8692, p. 86921Q). International Society for Optics and Photonics. https://doi.org/10.1117/12.2010316

Bao, X., Bar-Cohen, Y., Chang, Z., Dolgin, B. P., Sherrit, S., Pal, D. S., Du, S., & Peterson, T. (2003). Modeling and Computer Simulation of Ultrasonic/Sonic Driller/Corer (USDC). Ieeexplore.leee.org. https://doi.org/10.1109/TUFFC.2003.1235326

Bar-Cohen, Y., Sherrit, S., Dolgin, B. P., Bridges, N., Bao, X., Chang, Z., Yen, A., Saunders, R. S., Pal, D., Kroh, J., & Peterson, T. (2001). Ultrasonic/sonic driller/corer (USDC) as a sampler for planetary exploration. *IEEE Aerospace Conference Proceedings,* 1, 1263-1271. https://doi.org/10.1109/AERO.2001.931716

Cardoni, A., Harkness, P., & Lucas, M. (2010). Ultrasonic rock sampling using longitudinal-torsional vibrations. *Physics Procedia,* 3(1), 125-134. https://doi.org/10.1016/j.phpro.2010.01.018

Firstbrook, D., Harkness, P., & Gao, Y. (2014 Aug. 4). A novel study on high-powered ultrasonic penetrators in granular material. *AIAA SPACE* 2014 *Conference and Exposition*. https://doi.org/10.2514/6.2014-4265

Firstbrook, D., Worrall, K., Harkness, P., Flessa, T., McGookin, E., & Thomson, D. (2018). Ultrasonic Auger for Narrow-Gauge Borehole Drilling. *IEEE International Ultrasonics Symposium, IUS,* 2018-October. https://doi.org/10.1109/ULTSYM.2018.8579687

Firstbrook, D., Worrall, K., Timoney, R., & Harkness, P. (2018). Ultrasonically assisted hammer-Action penetrators in planetary regolith. *Earth and Space* 2018*: Engineering for Extreme Environments,* 359-368. https://doi.org/10.1061/9780784481899.036

Firstbrook, D., Worrall, K., Timoney, R., Sunol, F., Gao, Y., & Harkness, P. (2017). *An experimental study of ultrasonic vibration and the penetration of granular material*. https://doi.org/10.1098/rspa.2016.0673

Sherrit, S., Bao, X., Chang, Z., Dolgin, B. P., Bar-Cohen, Y., Pal, D., Kroh, J., & Peterson, T. (2000). Modeling of the ultrasonic/sonic driller/corer: USDC. *Proceedings of the IEEE Ultrasonics Symposium,* 1, 691-694. https://doi.org/10.1109/ULTSYM.2000.922641

Wang, Y., Quan, Q., Yu, H., Bai, D., Li, H., Access, Z. D.-I., & 2018, U. (2018). Rotary-percussive ultrasonic drill: An effective subsurface penetrating tool for minor planet exploration. *IEEE Access,* 6, 37796-37806. https://ieeexplore.ieee.org/abstract/document/8404025/

Young, C. W. (1997). Penetration equations. https://doi.org/10.2172/562498

The invention claimed is:

1. A vibratory burrowing probe device for probing subsurface regions within a granular medium, said device comprising:

a probe having a longitudinal axis; and included on said probe:

a probe tip that is shaped for penetration thereof through the granular medium in an axial direction denoted by said longitudinal axis of the probe; and a vibratory mechanism that is operable, in at least one mode of operation, to impart non-longitudinal vibration to the probe tip such that at least a partial component direction of said non-longitudinal vibration has a transversely oriented relationship to said longitudinal axis;

wherein said vibratory mechanism comprises a plurality of actuators distributed discretely of one another around the longitudinal axis of the probe, and said vibratory mechanism is operable, in said at least one mode of operation, to drive at least a first subset of said actuators asynchronously of at least a second subset of said actuators to impart said component direction of transversely oriented relationship to said longitudinal axis.

2. The device of claim 1 wherein the first and second subsets of the actuators each comprise a respective pair of actuators.

3. The device of claim 1 wherein the vibratory mechanism is configured to drive the actuators, at least in said one mode of operation, in a controlled manner in which a respective drive cycle of each actuator is offset relative to a neighbouring actuator by a phase angle difference that is equal to angular spacing between said actuators in a circumferential direction around the longitudinal axis.

4. The device of claim 3 wherein the actuators are arranged in diametrically opposing pairs across the longitudinal axis, and the respective drive cycles of the two actuators in each diametrically opposing pair are offset from one another by a phase angle difference of 180-degrees.

5. The device of claim 3 wherein the plurality of actuators consists of four actuators circumferentially spaced from one another by 90-degrees around the longitudinal axis, whereby the phase angle difference between each actuator and the neighbouring actuator is also 90-degrees.

6. A vibratory burrowing probe device for probing subsurface regions within a granular medium, said probe comprising:

a probe having a longitudinal axis; and included on said probe:

a probe tip that is shaped for penetration thereof through the granular medium in an axial direction denoted by said longitudinal axis of the probe; and a vibratory mechanism that is operable to impart vibration to the probe tip;

wherein said vibratory mechanism comprises a plurality of actuators distributed discretely of one another around the longitudinal axis of the probe, and said vibratory mechanism is operable, in at least one mode of operation, to drive at least a first subset of said actuators asynchronously of at least a second subset of said actuators to impart at least a partial component direction of the vibration that is of transversely oriented relationship to said longitudinal axis.

7. The device of claim 6 wherein said plurality of actuators are installed on the probe tip.

8. The device of claim 6 wherein said plurality of actuators are piezoelectric actuators.

9. The device of claim 6 wherein said first and second subsets of the actuators reside on opposing sides of a longitudinal midplane containing said longitudinal axis, of which the first and second subsets, at least in said one mode of operation, are driven in a controlled manner according to respective first and second drive cycles, between which there is a phase angle difference of 180-degrees.

10. The device of claim 6 wherein the first and second subsets of the actuators each comprise a respective pair of actuators.

11. The device of claim 6 wherein the vibratory mechanism is configured to drive the actuators, at least in said one mode of operation, in a controlled manner in which a respective drive cycle of each actuator is offset relative to a neighbouring actuator by a phase angle difference that is equal to angular spacing between said actuators in a circumferential direction around the longitudinal axis.

12. The device of claim 11 wherein the actuators are arranged in diametrically opposing pairs across the longitudinal axis, and the respective drive cycles of the two actuators in each diametrically opposing pair are offset from one another by a phase angle difference of 180-degrees.

13. The device of claim 11 wherein the plurality of actuators consists of four actuators circumferentially spaced from one another by 90-degrees around the longitudinal axis, whereby the phase angle difference between each actuator and the neighbouring actuator is also 90-degrees.

14. The device of claim 6 wherein said actuators are installed on a base of said probe tip.

15. The device of claim 6 wherein the plurality of actuators are configured to act in the axial direction, and on the probe is included a back mass that bears axially upon the actuators in direction toward a penetrative terminal end of the probe tip.

16. The device of claim 15 wherein said back mass is held against said actuators in a pre-loaded state exerting compressive force thereon.

17. The device of claim 16 wherein said back mass has a bore passing axially therethrough, though which a longitudinal shaft extends from the probe tip to a threaded segment of the longitudinal shaft that resides distally of the probe tip, and on which a threaded nut is engaged in a tightened state to hold the back mass in said pre-loaded state exerting said compressive force on the actuators.

18. The device of claim 17 wherein at least one of either said longitudinal shaft or said threaded nut doubles as a coupling component for operable connection of the probe to a mechanical drive source that is operable to apply longitudinal drive force to the probe.

19. The device of claim 6 wherein said plurality of actuators are piezoelectric actuators.

20. The device of claim 6 wherein said first and second subsets of the actuators reside on opposing sides of a longitudinal midplane containing said longitudinal axis, of which the first and second subsets, at least in said one mode of operation, are driven in a controlled manner according to respective first and second drive cycles, between which there is a phase angle difference of 180-degrees.

* * * * *